US005979347A

United States Patent [19]

Schips

[11] Patent Number: 5,979,347

[45] Date of Patent: Nov. 9, 1999

[54] METHOD AND ARRANGEMENT FOR FOLDING AND STACKING SEWING GOODS

[75] Inventor: Helmut Schips, St. Gallen, Switzerland

[73] Assignee: Schips AG Naehautomation, Truebach, Switzerland

[21] Appl. No.: 09/086,661

[22] Filed: May 29, 1998

[30] Foreign Application Priority Data

May 30, 1997 [DE] Germany ..... 197 22 610

[51] Int. Cl.[6] ..... D05B 33/00

[52] U.S. Cl. ..... 112/475.06; 112/475.07; 112/470.36

[58] Field of Search ..... 112/475.06, 475.07, 112/470.36, 147, 311, 304, 217.1, 260; 271/198, 189, 3.01

[56] References Cited

U.S. PATENT DOCUMENTS 3,704,884 12/1972 Nicolay et al. ..... 112/470.36 X
3,965,831 6/1976 Weir ..... 112/470.36 X
4,067,272 1/1978 Marforio ..... 112/470.36
5,018,463 5/1991 Nakajima ..... 112/470.36
5,159,889 11/1992 Price et al. ..... 112/470.36

*Primary Examiner*—Ismael Izaguirre
*Attorney, Agent, or Firm*—Lackenbach Siegel Marzullo Aronson & Greenspan, P.C.

[57] ABSTRACT

The invention relates to a method and an arrangement for folding and stacking sewing goods disposed downstream of a sewing machine and separated from it by an interspace, wherein a transfer device bridging this interspace and succeeding transport device are available by which the sewing good is removed from the sewing machine and supplied to the stacking device.

In the interspace is provided a vertical clamping device through which a portion of the sewing good while being clamped is taken hold of and transported in the vertical direction by a defined magnitude [distance], and subsequently the remaining portion of the sewing good is transported in a transport gap formed by a support surface of the stacking device and the transport device which, with respect to it, can be raised and lowered. The sewing good is therein folded and can be deposited in the correct position by the stacking device.

15 Claims, 11 Drawing Sheets

METHOD AND ARRANGEMENT FOR FOLDING AND STACKING SEWING GOODS

Figure 1:
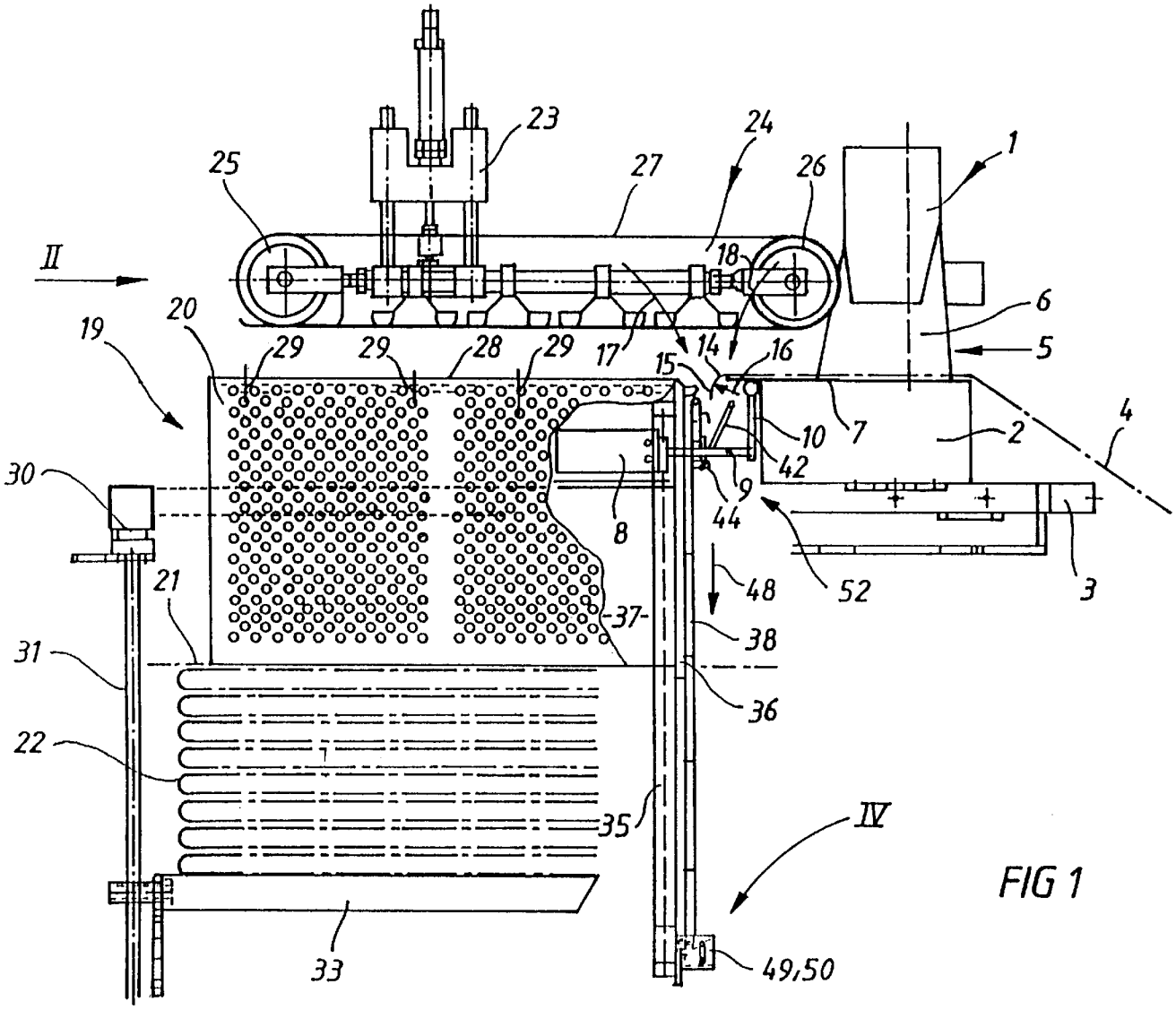

The invention relates to a method and an arrangement for stacking sewing goods according to the preamble of patent claim 1.

In specific sewing operations, for example when producing briefs and other underwear it is necessary to provide these items of underwear stepwise with specific seams in order to apply, for example, leg border bands, waist bands and the like. It is herein known to carry out such sewing operations sequentially, wherein for example with the same sewing machine the left and subsequently also the right leg cut is edged with elastic.

In a subsequent sewing operation it becomes necessary to close the so-called tab or gusset and to place leg cuts (front and rear part of the item of underwear) one on top of the other such that the elastic bands, which are still open, of the left and the right leg opening come to lie precisely one on top of the other in order to sew in the subsequent sewing operation the two bands in the correct position one above the other by closing the gusset.

In such sewing operations it is thus required that the seamstress sew first onto the left and then onto the right leg opening said elastic band in order to stack in order subsequently the semifinished item of underwear in order to supply starting from this stack the item of underwear to the next sewing operation, namely the closing of the gusset.

Until now it was only known that the seamstress took the semifinished sewed sewing item manually from the sewing machine area and deposit it at a specific stacking site. But this entailed the disadvantage that the orderly and problem-free transfer to the next sewing station was no longer possible.

In another embodiment according to prior art it was known that the seamstress took the part to be sewn in order and the bands associated one with the other and to be sewn were placed such and deposited them in the correct shape that in the subsequent sewing operation the cited parts were immediately again associated with one another in the correct position.

The invention is therefore based on the task of developing further a method and an arrangement for folding and stacking goods to be sewn of the above cited type such that the sewing good transferred into the stacking device is stacked in the stacking device such that it is stacked in the correct position and according to shape with the object that it can also be supplied in the correct position and according to shape to the next sewing operation.

To solve the posed task the invention is characterized through the technical teaching of claim 1. The invention builds on known prior art which provides that downstream from a sewing machine a stacking device is disposed and that between the sewing machine and the stacking device an interspace is disposed. It is further known that a transfer unit and transport device is provided bridging this interspace which is implemented for example as a belt transport which is capable of removing the sewing good from the delivery side of the sewing machine and to move it in order to the stacking device.

The invention provides as technical teaching that in the interspace between the delivery side of the sewing machine and the intake side of the stacking device a vertical clamping device is disposed which is capable of taking hold under clamping a part of the sewing good, for example the sewing good start and to transport it in the vertical direction with the remaining portion of the sewing good being transported in a transport gap whose one side is formed by a support surface of the stacking device and whose other side by a belt transport which is implemented such that it can be lowered and raised.

The given technical teaching yields the substantial advantage that now a stacking device is suggested which is simultaneously capable of folding the sewing good before stacking it.

Therewith the further advantage is attained that immediately after completing the sewing of the sewing item this is brought with its sewing start into a vertical clamping device which receives the front portion of the item of the sewing good and moves it vertically downwardly and in the process tensions it. The remaining portion of the sewing item is transported from the sewing machine also into the transport gap between the belt transport and the support surface of the stacker and is folded there.

Thus, for the first time the possibility is given that before the stacking of the completely sewn sewing good it can be folded in said device whereupon it is deposited in the folded state and ordered onto a stacking surface of the stacker.

With the given technical teaching the necessity becomes superfluous that the seamstress must again manually acquire the sewing item in order to place it in order onto a stacker and must therefore supply it in an ordered state to a subsequent sewing operation.

On the other hand, the necessity becomes also superfluous of having to remove the sewing items cast in nonordered state into a box in order to bring them subsequently before the next sewing operation in the correct position and shape to be able to continue sewing them.

With the given technical teaching thus the substantial advantage results that immediately at the delivery of the sewing machine a folding operation takes place and this folding operation takes place shortly before the stacking such that no longer the danger exists that the folded item becomes twisted or shifted in undesirable manner such that it can be deposited in correct position and shape onto the stacking plane of the stacker.

In a first embodiment of the present invention it is provided that the vertical clamping device, which carries along the sewing good, is moved by a defined magnitude (distance) downwardly. This embodiment is suitable for depositing the sewing good in the correct position on the right which means with the useful side to the outside.

This embodiment is characterized by the technical teaching that a vertical clamping device is available which is disposed substantially below the sewing table and whose clamping device moves vertically in the downward direction.

If, on the other hand,—in another embodiment of the invention—the sewing good is to be deposited to the left, which means with its backside on the outside, it is provided in this embodiment that the vertical clamping device is disposed substantially above the sewing table and the clamping device is not moved vertically downwardly but rather in the upward direction.

Both embodiments are encompassed by the technical teaching of the invention. Thus, the invention provides a vertical clamping device above as well as also below the sewing table and the vertical clamping device disposed underneath the sewing table, the sewing good is folded on the right while with the vertical clamping device disposed above the sewing table, the sewing good is folded on the left. Both clamping devices can be available concurrently; but it can also be provided that only a single clamping device (thus either the clamping device subjacent or superjacent) is available.

If one works with the vertical clamping device which is disposed underneath the sewing table, a displacement device for the vertical clamping device is provided which is disposed above the sewing table in order to transport it from the work area. Thus either only the one clamping device or the other clamping device is applied.

The term "vertical" is only to be understood by example for the reference to the position and location of these two clamping devices. It is understood that it is also possible that these two clamping devices with their particular longitudinal axis are not precisely perpendicular to the direction of transport and to the support plane of the sewing table but they can also be inclined at a specific angle to the support plane of the sewing table.

The present invention is also not limited to the effect that the particular vertical clamping device is comprised of a transport belt (toothed belt) on which a carriage is attached on whose carriage, in turn, the clamping device is secured. Instead of such a clamping device which can be lowered and raised, connected with a transport belt operating in the vertical direction, other possibilities exist which are also encompassed by the present invention as being essential to the invention. Instead of this described transport belt, which lifts the clamping device in the vertical direction, it is understood that it is possible to use another lifting device for the clamping device. Such a lifting device can be for example a lifting piston, a spindle or also a pivot arm which is pivotable about a horizontal axis and at whose front free end the clamping device is disposed. Thus, important with respect to this clamping device is only that it is implemented substantially so as to be liftable or lowerable in the vertical direction either above the sewing table support surface or below the sewing table support surface.

For the further description applies that the two embodiments which will also be described in the drawings, are implemented to be substantially identical. They differ only by the vertical clamping device and by the transfer and by characteristics of the transfer device.

For the realization of the technical teaching according to the present invention several different embodiments for further details are suggested.

It is first provided that a transfer arrangement between the delivery side of the sewing machine (sewing machine table) and the vertical clamping device is available. This transfer device can be realized in various ways.

In a first preferred embodiment this transfer device is implemented as a clamping plate. This clamping plate has a dual function because it serves, for one, as a transfer station for the transfer of the sewing good start into the vertical clamping device (in this process position the clamping plate serves only as transfer arrangement, but does not have a clamping function). In the other function of this device it also produces the fold of the sewing good, namely if the sewing good is introduced into the transport gap between the lower belt portion of the belt transport and the support surface of the stack and is transported further.

In addition to the transfer device which is suitable for bridging the interspace between the delivery side of the sewing machine and the intake side of the stacker device, a so-called vertical clamping device is disposed in this interspace. The vertical clamping device comprises substantially a clamping clip clampable by means of a piston, which is suitable to receive the start of the sewing good and subsequently the sewing good start clamped in this way is moved with the vertical clamping device onto a carriage on the stacker vertically in the downward direction in order to transport the sewing good downwardly without tensioning it substantially. Thus only a specific length of the sewn sewing good in the region of the sewing machine is to be removed and specifically as much as is necessary to form a creased fold to be provided approximately in the center of the sewing good. Thus as soon as the simple length of the creased fold has been reached, the vertical clamping device remains in its lowered position and the remainder of the sewing good is subsequently brought with the aid of the clamping plate (transfer station) now used as clamping device into the transport gap between the belt transport and the stacker, whereby the creased fold is formed.

In a succeeding process step the clamping device subsequently moves upward again, releases the sewing good start such that the sewing good is folded and is disposed in full width on the stacking surface of the stacker and it subsequently can be deposited on a stacker surface in orderly form.

It is preferred if the clamping device takes hold of the elastic to be further processed in a later sewing operation (for example on the leg cutout of the sewing item), since only through this taking-hold in the correct position of the elastic to be processed further subsequently is ensured that this elastic is finally deposited on the stacker device so as to be oriented correctly with respect to position and is subsequently stacked.

Therewith the two elastic ends of one and the same leg cutout are positioned precisely correctly one above the other and subsequently can be further sewn in the next sewing operation without manipulation expenditures.

The previously described transfer device with the described clamping plate thus applies to both embodiments, namely to the one which disposes the clamping device above the sewing table support surface and also to the other embodiment which disposes the clamping device underneath the sewing table support surface.

But if the clamping device is disposed above the sewing table support surface, further elements of a transfer device implemented differently are present. It is namely provided that this further transfer device comprises a transfer slide which is driven such that it is movable in the direction of the sewing transport, and as drive is preferably used a pneumatic piston-cylinder drive. Starting from the proximity of the sewing head, it moves in the direction of sewing rearwardly in the direction toward the stacker, in the process carries the sewing good along and forms the creased fold whose free front end is received by the vertical clamping device.

The subject matter of the present invention is not only evident on the basis of the subject matter of the individual patent claims but also from the combinations with each other of the individual patent claims.

All specifications and characteristics disclosed in the documents, including the abstract, in particular the spatial implementation depicted in the drawings are claimed as being essential to the invention to the extent they are novel individually or in combination relative to prior art.

In the following the invention will be explained in further detail in conjunction with drawings representing several embodiment paths. In the drawings and their description further characteristics and advantages of the invention and essential to it are evident.

In the Drawings Depict

Figure 2:
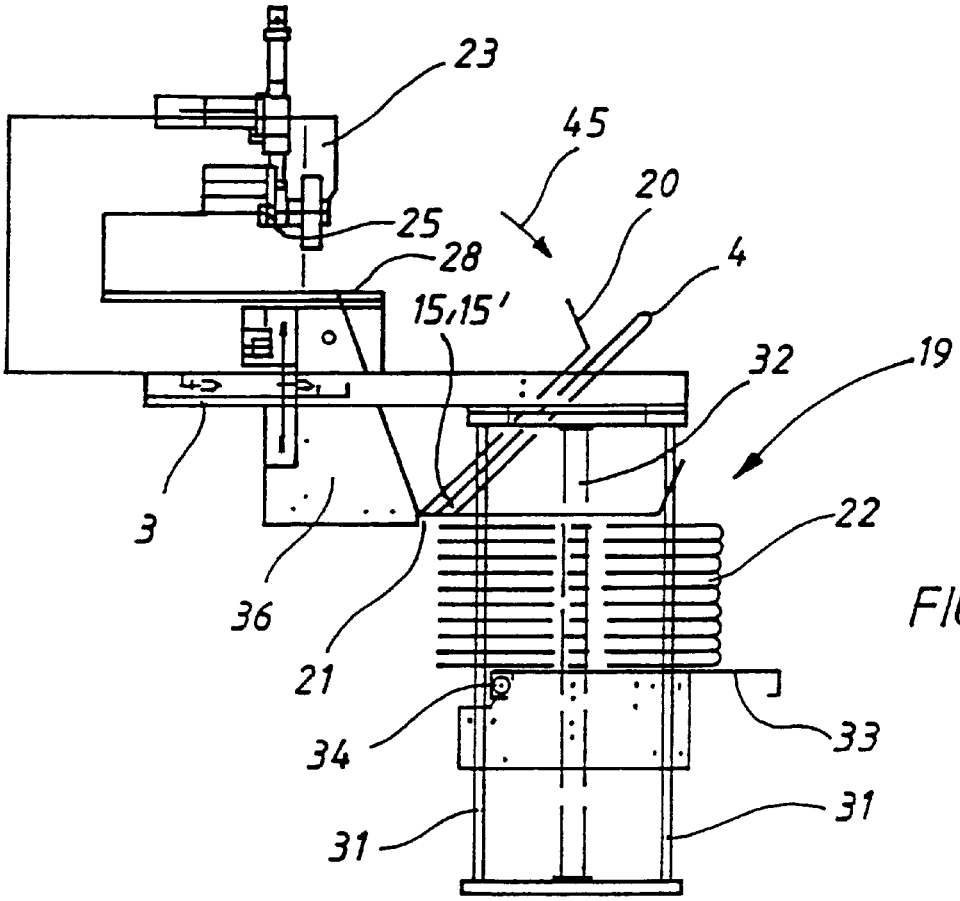
Figure 4:
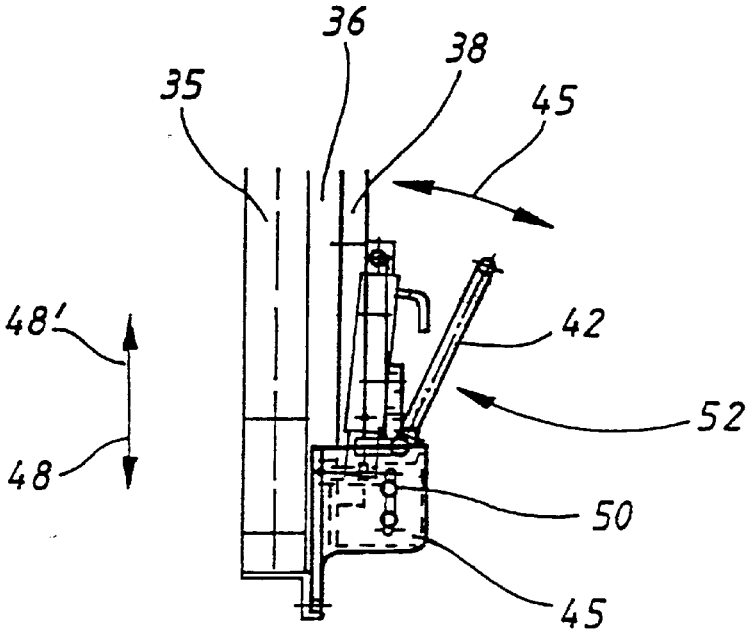
Figure 3:
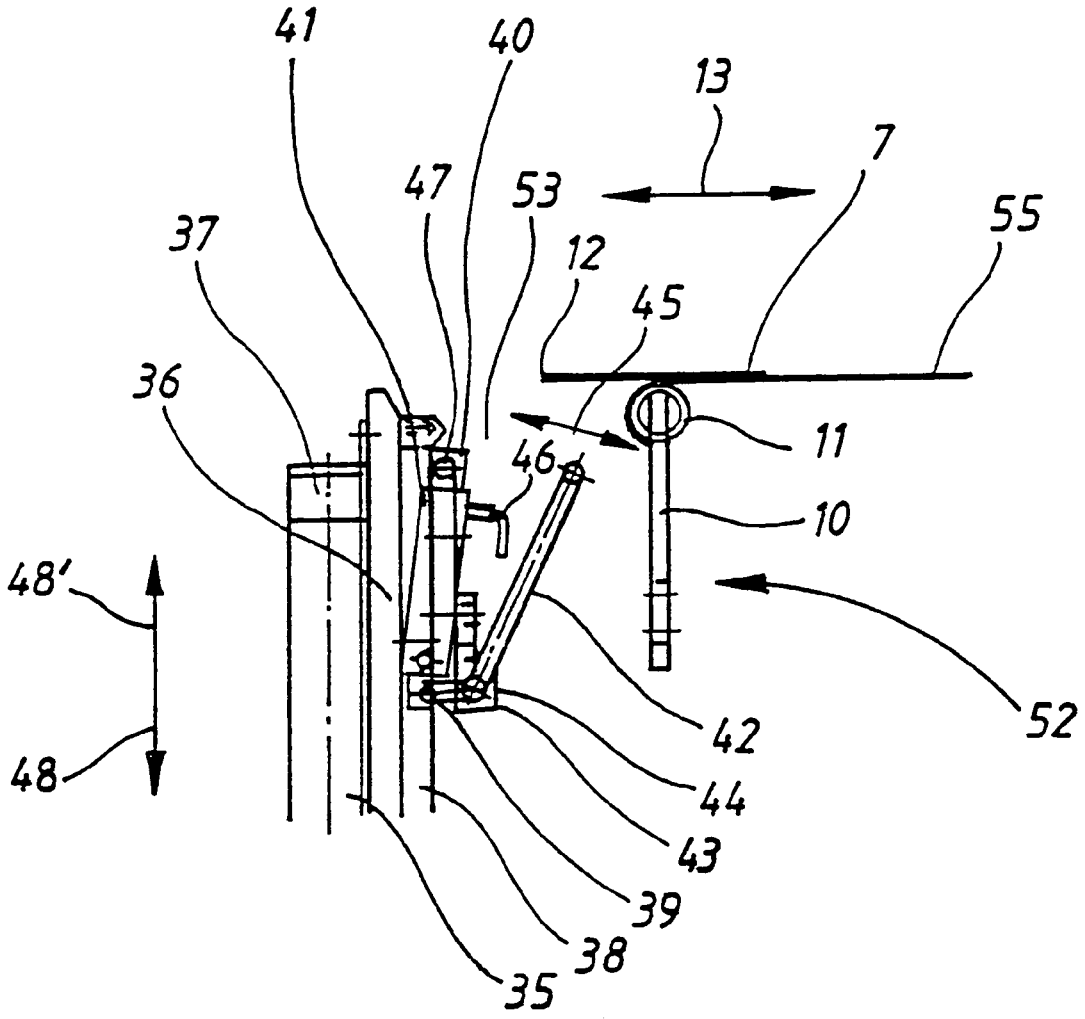
Figure 5:
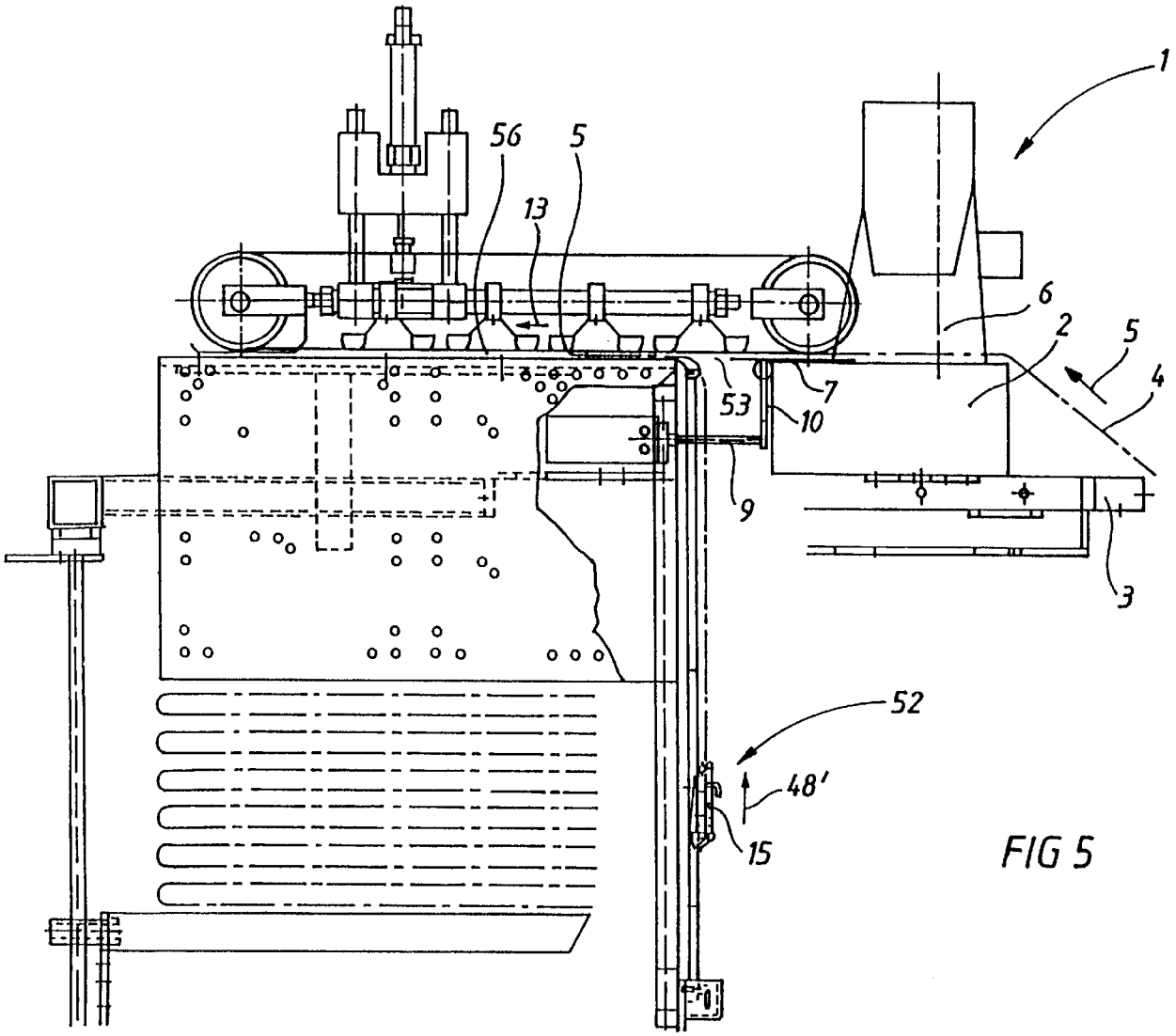
Figure 6:
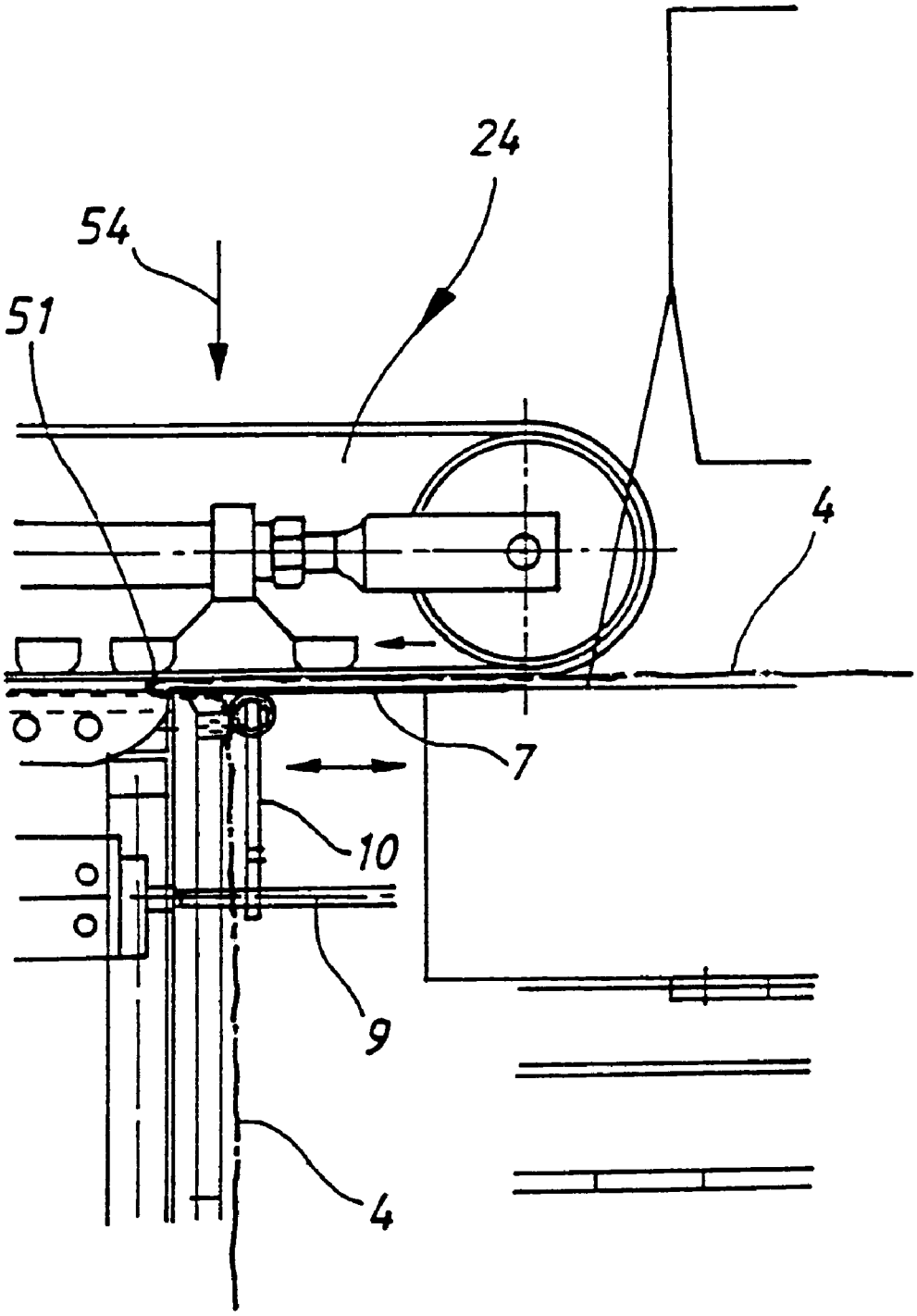
Figure 7:
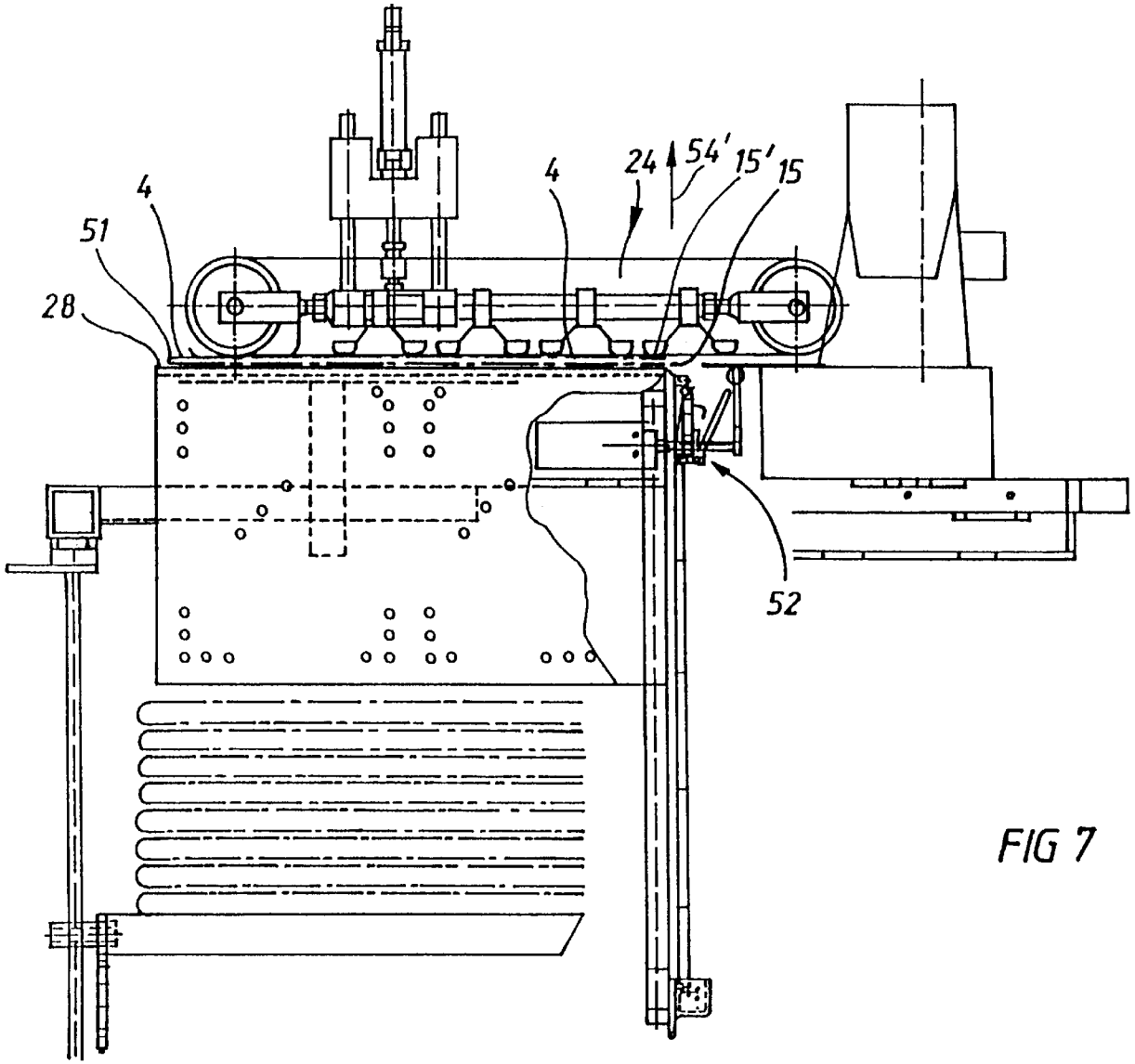
Figure 8:
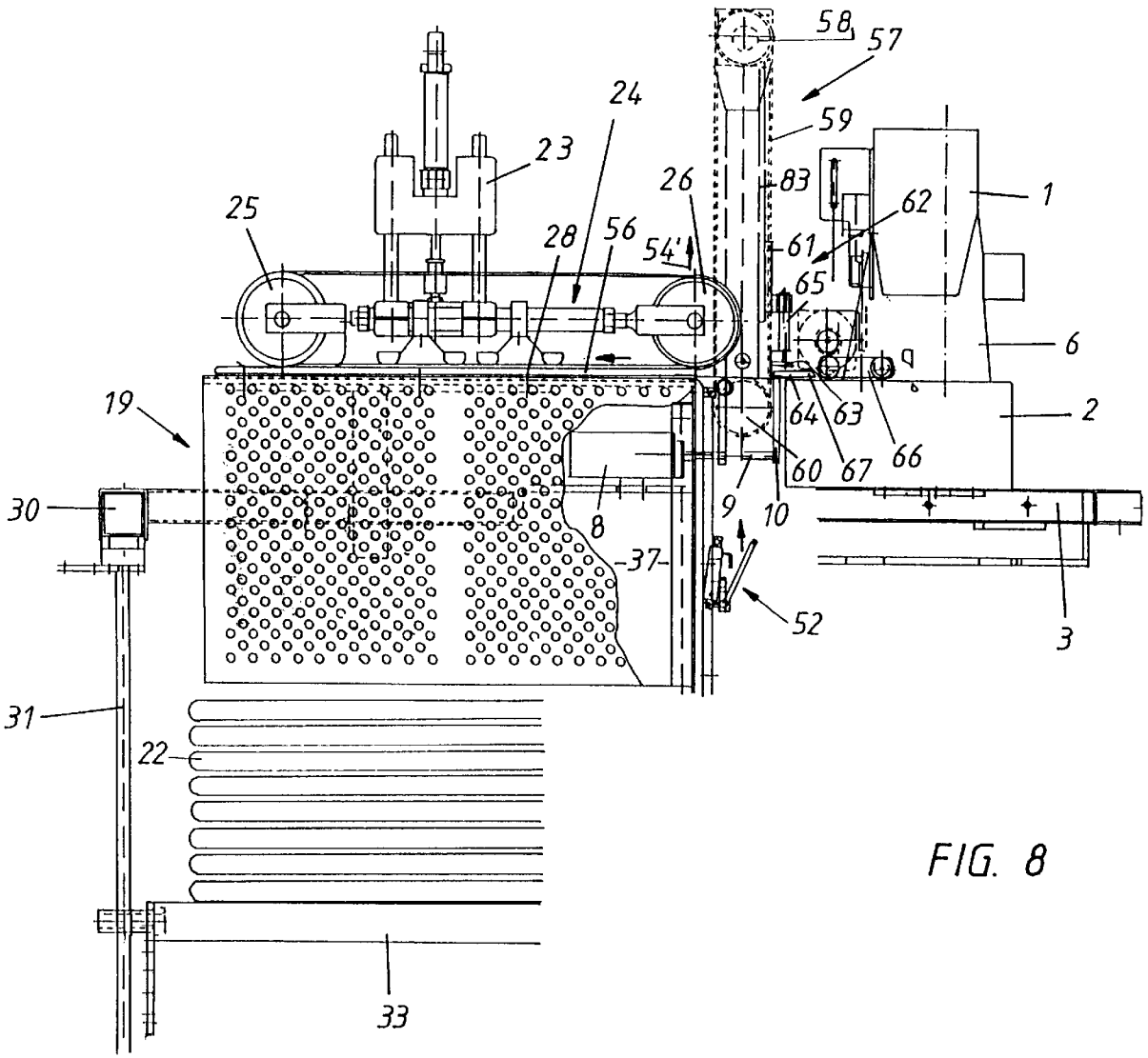
Figure 9:
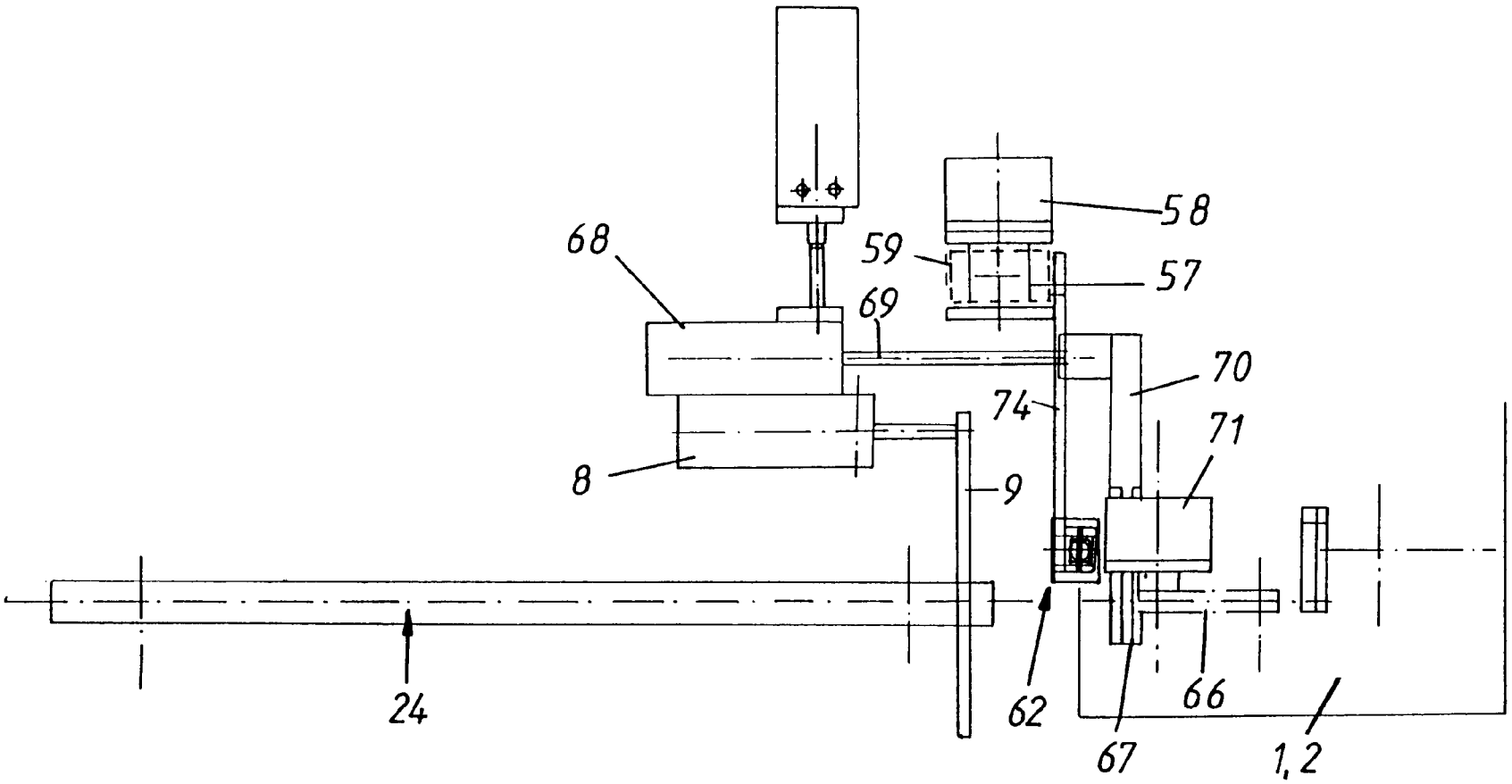
Figure 10:
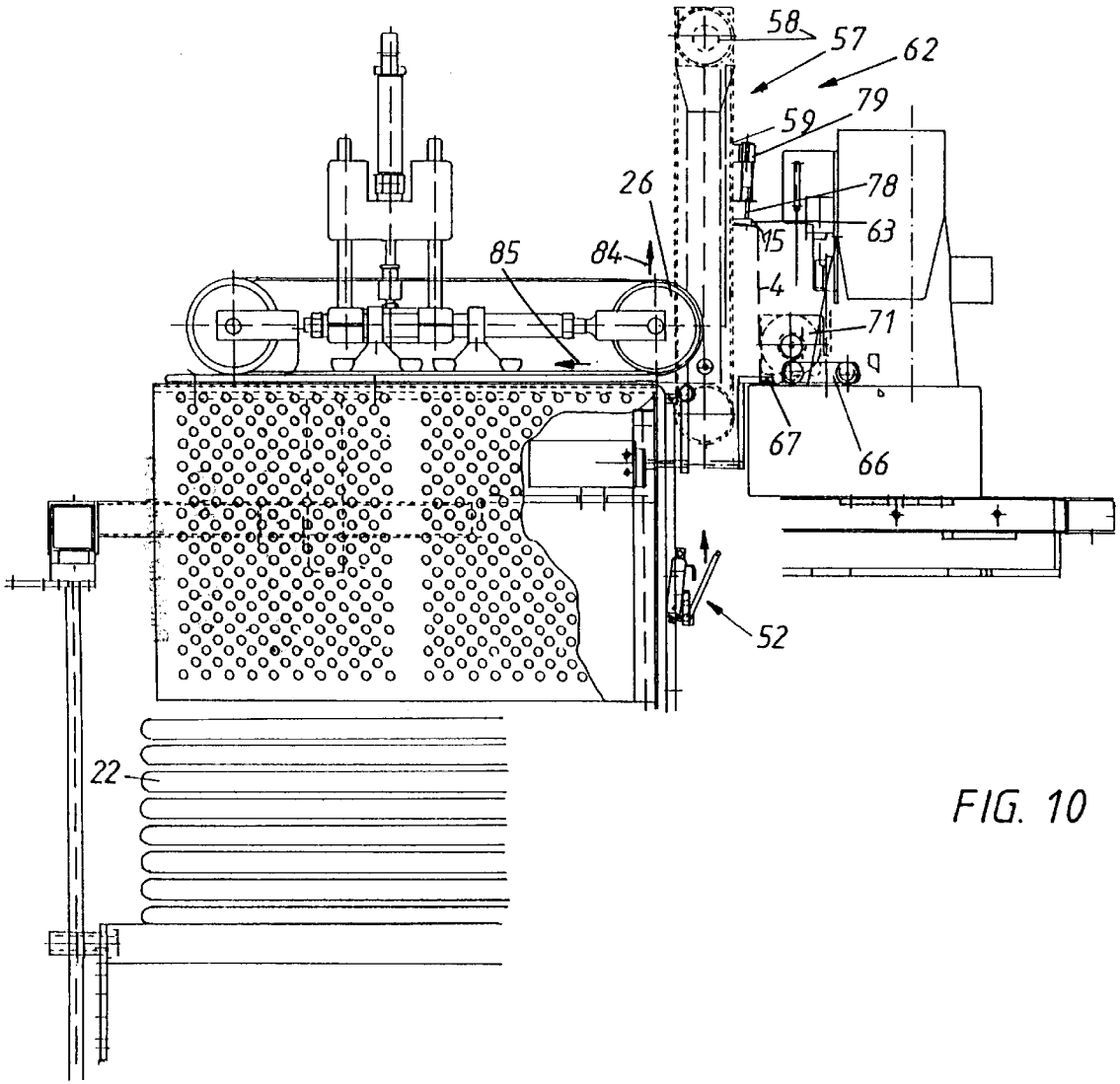
Figure 11:
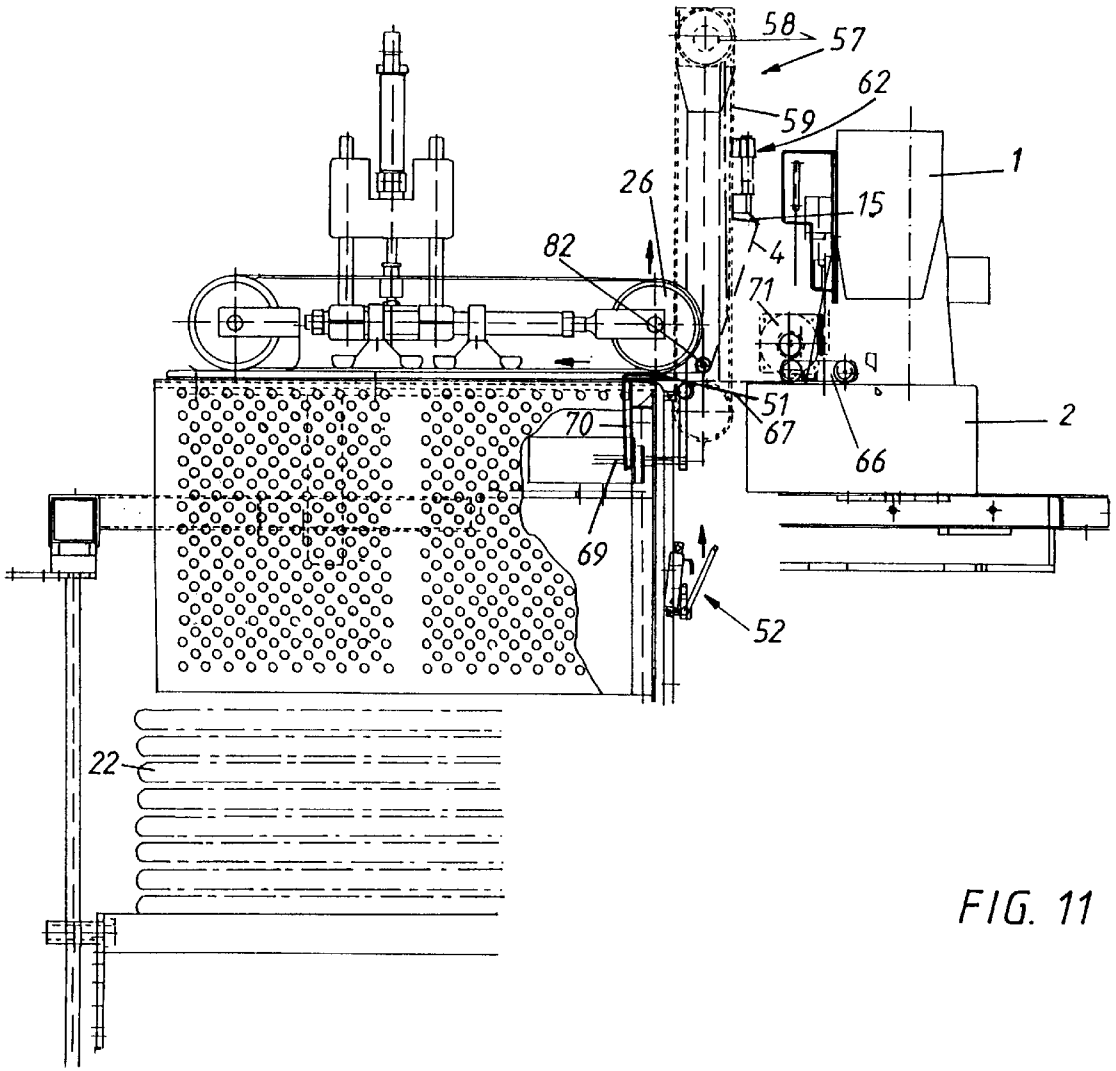
Figure 12:
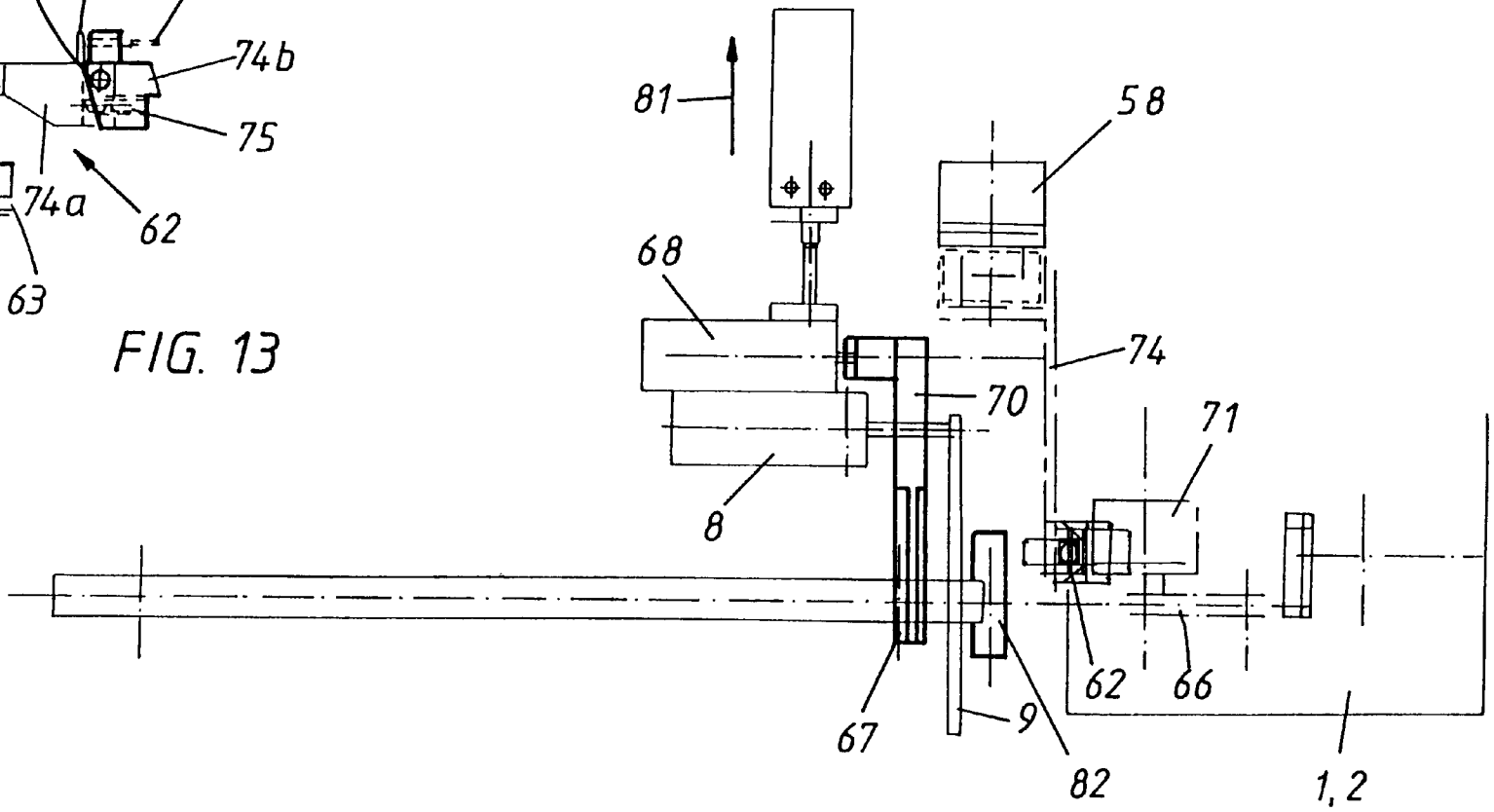
Figure 13:
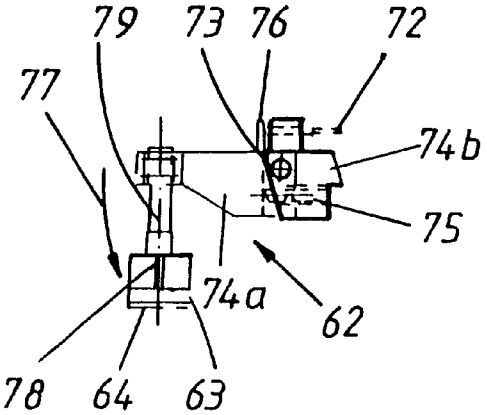

FIG. 1: schematically in front view the stacker device with folding device according to the invention, FIG. 2: side view of the arrangement in the direction of arrow II in FIG. 1, FIG. 3: an enlarged representation of the vertical clamping device, FIG. 4: an enlarged representation of the vertical clamping device in the lowered position according to arrow IV in FIG. 1, FIG. 5: the same representation as FIG. 1 with a folded sewing good item, FIG. 6: an enlarged representation of the transfer region between sewing machine and stacker device in a further process step, FIG. 7: end stage of the folded sewing good in the stacker device, FIG. 8: side view of a second embodiment of a stacking and folding device at the start of the transfer process, FIG. 9: top view onto the representation according to FIG. 8, FIG. 10: the representation according to FIG. 8 in an advanced working state shortly before formation of the creased fold, FIG. 11: a representation continued in time relative to FIG. 10 of the folding process at which the crease for the sewing good has already been formed, FIG. 12: the top view onto the representation according to FIG. 11, FIG. 13: an enlarged representation of the mounting of the vertical clamping device with an overload protection device.

In FIG. 1 is depicted schematically a sewing machine and, for reasons of simplification, only the sewing head 1 is shown which comprises a pressure foot 6 shown schematically.

The sewing good 4 is herein disposed on a sewing table and the sewing machine comprises overall a frame 3, comprising the listed parts. At a distance from the delivery (left) of the sewing table 2 is provided an interspace 53 (FIG. 3) which separates the delivery region of the sewing machine from a stacker 19.

The sewing good 4 is herein transported into this interspace 53 in the direction of arrow 5.

The transfer station between the sewing machine (sewing head 1) and the stacker 19 comprises a clamping plate 7 which in the example comprises a metal plate which is driven so as to be displaceable in the horizontal direction (direction of arrow 13, FIG. 3).

Stated more precisely, this transfer device comprises a support plate 55 on which is disposed a clamping plate 7 so as to be displaceable in the directions of arrow 13, which is implemented approximately in the form of a tongue. It is herein provided (but not shown graphically) that on the front side of the clamping plate 7 are additionally present associated curvatures, radii or other repelling faces which ensure that according to FIG. 1 the sewing good is guided in the direction of arrow 16 (radius) as sewing good start 15 over the edge 12 of the clamping plate 7, wherein the sewing good thus forms a curved edge 14.

It is herein preferred if blowing devices are present acting in the direction of the indicated directions of arrow 17, 18, which are capable of blowing the start of the sewing good 15 over the edge 12 of the clamping plate 7 so that it is moved into the interspace 53 between the sewing machine and the stacker 19.

In this interspace is disposed a vertical clamping device 52 which substantially comprises the following parts.

On the side wall of the stacker 19 is disposed a guide rail 38 in which carriage 39 is driven such that it is movable in the vertical direction (directions of arrow 48), which carriage 39 supports a bearing block 43 on which is disposed a pivot axle 44 for a clamping clip 42 projecting approximately vertically upwardly.

On the carriage 39 is further disposed a cylinder 40 which is supported in an upper horizontal pivot bearing 47. The cylinder 40 engages with its piston rod the free pivotable end of the clamping clip 42 implemented as two-armed lever, which therewith can be brought into the directions of arrow 45 into its opening or closing position.

Only for the sake of completeness a connection 46 for the air supply of cylinder 40 is additionally shown graphically.

For the vertical displacement driving of the carriage 39 only gravity is provided which ensures that the carriage 39 falls downwardly in the direction of arrow 48 in its carriage track (guide rail 38).

Instead of the motion of the carriage solely by gravity, it is understood that it is also possible to move the carriage optionally for example by joining it to a lifting spindle or by displacing it pneumatically.

The drive in direction of arrow 48' acting in the upward direction contrary to the indicated direction of arrow takes place by pulling the sewing good in the transport gap between the transport, respectively belt, device 24 to be described later, and the associated support surface 28 of stacker 19.

This is also an advantageous embodiment of the vertical clamping device which does not require a separate displacement drive.

For the sake of completeness it is additionally shown that on the side wall of the stacker 19 a cylinder 35 is disposed which is implemented as block cylinder and which ensures that in an emergency in which the vertical clamping device has not taken hold of a piece of sewing good and is located in the vertically lowered position, the operator without great manipulation expenditure can bring the vertical clamping device 52 into its starting position shown in FIG. 1 again.

To trigger this safety function a switch 50 is disposed in a housing 49 which is only actuated if in an emergency the vertical clamping device 52 with its carriage 39—without the start of the sewing good 15 having been clamped—actuates the switch 50.

For opening the clamping clip 42 a proximity switch 41 (FIG. 3) is provided in the upper region of carriage 39, which ensures that the clamping clip 42 opens and which is actuated as soon as the carriage 39 is located in its raised position according to FIG. 1.

The stacker 19 comprises a frame and a stacker flap 20 which is implemented so as to be pivotable in a horizontal axis 21. Below the stacker flap 20 a horizontal metal deposition sheet 31 is provided on which the folded sewing good is deposited in order as sewing good stack 22.

The metal deposition sheet 33 is always held on a specific deposition level for which purpose a lifting device is available. The lifting device comprises substantially two parallel guide rods 31 on which the metal deposition sheet is disposed so as to be displaceable. On the metal deposition sheet 33 acts the (not further shown) piston rod of a lifting cylinder 32, which ensures that the metal deposition sheet 33 is implemented so as to be height-adjustable in the vertical direction.

On the side face of stacker 10 is provided a cover 36 on which the guide rail 38 for the vertical clamping device 52 is mounted.

The belt device 24 comprises a lifting device 23 which ensures that the tape device is implemented so as to be raisable and lowerable. (see direction of arrow 54, 54').

The belt device 24 comprises two deflection wheels 25, 26 which are each supported on horizontal axes in a frame and over which the belt 27 runs. The lower belt of this belt 27 in specific lifting positions of the belt device 24 forms a transport gap in connection with the support face 28 of stacker 19.

The belt 27 is herein held taut with the aid of spring elements and exerts a specific clamping effect onto the sewing good transported in the transport gap.

The procedure when folding a sewing good item will be described in further detail with reference to FIGS. 1, 3 and 5 to 7.

In FIG. 1 is shown that the start of the sewing good 15 with its bent-off front edge 14 is introduced into the interspace 53 between the sewing machine and the stacker 19. This sewing good start 15 is now introduced into the open clamping gap of the vertical clamping device 52 with the clamping clip 43 being open. The transfer device implemented in two parts was displaced with its clamping plate 7 forward and to the left in the direction of arrow 13 such that it assumes approximately the position according to FIG. 1 and 3.

The sewing good start is therefore introduced into the opened vertical clamping device with the clamping clip 42 being open.

Associated with the support plate 55 is a support 10 which is disposed vertically and free at the front end of the piston rod 9, which is driven by a cylinder 8 in the directions of arrow 13 and the opposite direction.

The support 10 is fixedly connected with the clamping plate 7 implemented displaceably and specifically via a guide part 11.

In this way thus the clamping plate 7 is supported and guided so as to be telescopable in the horizontal plane in the support plate 55.

As soon as a specific portion of the sewing good start 15 has been introduced into the open vertical clamping device 52, the clamping clip 42 closes and the vertical clamping device moves downwardly in the direction of arrow 48 wherein due to gravity the carriage 39 is shifted downwardly in the guide rail 38.

The sewing good is further shifted from the delivery region of the sewing head 1 until, by an adjustable length it is determined that half of the sewing good to be folded now is stored on the side face of stacker 19 through the vertical clamping device.

Through a corresponding control pulse now the clamping plate 7 is shifted further to the left in the direction of arrow 13 whereby the entire interspace 53 between the delivery region of the sewing machine and the vertical clamping device is being bridged and the remaining sewing good material (cf. FIG. 5, 6) is now brought into the transport gap of the belt device 24 which, in the meantime, has already been lowered, which at a close spacing has been lowered over the support surface 28 of the stacker 19. The creased fold 51 which hereby forms in the sewing good (cf. FIG. 5) is now transported through the transport gap 56 to the left in the direction of arrow 13 and specifically into a position indicated in FIG. 7. This position shows that the creased fold 51 now has reached the outer left end of the stacker and thus also the support surface 28 and the sewing good now is ready for stacking. It is important that with the further pulling-forward of the creased fold 51 in FIG. 5 in the direction of arrow 13 to the left simultaneously the vertical clamping device with the sewing good start 15 clamped there is moved upwardly in the direction of arrow 48', which motion is generated alone by friction of the belt device 24 on the doubly folded sewing good on the support surface 28.

FIG. 7 shows lastly the end state in which the vertical clamping device is open and the sewing good end 15' is disposed directly above the sewing good start 15 such that the two listed parts are superjacent in the correct position and are now ready for stacking on the sewing good stack 22.

The stacking takes place by the stacker flap 20 which is pivotable in said axis 21 in direction of arrow 45 as is shown in FIG. 2.

FIG. 2 shows clearly that sewing good start and sewing good end 15, 15' have been placed one above the other precise with respect to position.

To facilitate the stacking according to FIG. 2 it is provided that in the position of the sewing good according to FIG. 7 needles 29 are provided on the stacker, which reach through the sewing good and fix the sewing good in its folded position according to FIG. 7 on the stacker until the stacker flap 20 has acquired the sewing good and has deposited it on the sewing good stack 22.

The incline of the metal deposition sheet 33 is implemented such that it can be adjusted through a pivot bearing 34 pivotable in the horizontal plane.

The present invention not only provides that the sewing good start and the sewing good end 15, 15' are disposed precisely congruently one above the other and are implemented of equal length. This is not necessary for the solution. In another embodiment it can be provided that, for example, the sewing good start 15 projects beyond the sewing good end 15' in order to facilitate the subsequent working process. It is only important that the elastic band whose one end is defined by the sewing good start and whose other end by the sewing good end, is placed correct with respect to position one above the other in order to accelerate a subsequent working in a succeeding station and to make it more precise.

In FIG. 8 is shown as a further embodiment example the clamping device which is disposed above the sewing table plane and which comprises substantially the vertical clamping device 57 which, in turn, comprises an upper and lower deflection wheel 60 over which a toothed belt 59 runs. The toothed belt is driven via a stepping motor 58 (FIG. 9). On the toothed belt 59 is fixedly secured a carriage 51 which bears the vertical clamping device. This comprises substantially—see FIG. 10—a clamping cylinder 79 which acts with its piston rod 78 onto an upper clamping jaw 63. This clamping jaw 63 is fixedly opposed by a lower clamping jaw 64 because this is fastened on the cylinder housing.

Between these two clamping jaws 63, 64 is formed a clamping gap for receiving the sewing good start 15.

It is additionally important in FIG. 8 that on the plane of the sewing table 2 a transport belt 66 driven in the direction of the sewing good is provided which is driven by the driving motor 71 (see FIG. 9).

This transport belt 66 transports the sewing good 4 starting from the stitching plane in the direction toward the vertical clamping device 62.

FIG. 8 shows now that in this transfer position the clamping device 62 is open because the cylinder 65 is controlled correspondingly and the clamping jaws 63, 64 are now ready for accepting the sewing good start 15.

The transfer slider 67, which is connected with the lever 70 and is driven by a cylinder 68 with piston rod 69, is in its starting position. This is evident in FIG. 8 by the fact that this transfer slider 67 is located at the delivery of the transport belt 66 and disposed in front of the opened clamping device 62.

The sewing good is now moved according to FIG. 8 with its sewing good start 15 into the clamping device 62, wherein the clamping jaws 63, 64 are closed and the entire clamping device 62 simultaneously moves upwardly in the direction of arrow 84, as is shown in FIG. 10. With increasing processing of the sewing good thus, corresponding to the sewing good speed, the clamping device 62 is synchronously pulled upwardly in the vertically disposed clamping device 57.

The transfer slider 67 according to FIG. 10 is still in its starting position.

According to one half of the processing length of the sewing good now the transfer slider 67 is moved in the direction of arrow [sic] wherein the cylinder 68 is driven and the piston rod 69 is moved into the cylinder.

According to FIG. 11 the creased fold 51 is formed around the transfer slider 67 wherein the sewing good is guided around a deflection roller 82.

During this formation of the creased fold 51 the clamping device 62 moves downwardly in the direction opposite to the arrow 84 and with advancing sewing transport speed the creased fold 51 in FIG. 11 migrates to the left into the transport gap 56 of the belt device 24.

Depending on the length of the sewing good, thus the creased fold 51 moves to the left and, as soon as the sewing good has been worked completely, it is substantially folded in the region of this stacking device 19 where the sewing good, according to the above provided description, is deposited in the folded state on the metal deposition sheet 33.

FIG. 12 shows that either only the one vertical clamping device 57 or the other vertical clamping device 52 is active. If only the vertical clamping device 52 is used, the other vertical clamping device 57 remains in the sewing region, only the transfer slider 67 is moved out of the sewing region. For this purpose is provided a carriage drive 80 which with its piston rod engages the driving cylinder 68 for the transfer slider 67 and can move it in the direction of arrow 81 such that it subsequently is transported out of the sewing region.

All other devices, in particular the two vertical clamping devices 52 and 57 however, remain thus and cannot be moved.

It is understood that according to a further development of the present invention it is also possible to implement these clamping devices such that they are automatically movable or to provide only one of the two clamping devices 52 or 57 whereby all three embodiments are claimed as essential to the invention. It is further added that the previously cited carriage 61 is displaceable in the vertical direction (direction of arrow 54' and oppositely) in a guide rail.

FIG. 13 shows an overload device which can be used for the upper clamping device 62 as well as also for the lower clamping device 52.

In the following, this overload device will be described in further detail in connection with the upper clamping device 62.

It is evident in FIG. 12 that the clamping device 62 is connected via a lever 74, directed approximately in the horizontal direction, with the drive (i.e. thus with the carriage 61). This lever is shown in top view for example in FIGS. 9 and 12.

According to the invention this lever 74 is now implemented in two parts and comprises a front part 74*a* and a rear lever 74*b*, which are both implemented as lever components and which are connected via a horizontal pivot axis 73 so as to be pivotable. In the operating position the lever components 74*a*, 74*b* are connected through, i.e. they form a straight continuous line with levers 74*a*, 74*b* abutting a stop 76 and being extended hereby.

If the clamping device is overloaded, i.e. if the material is clamped in the clamping gap between clamping jaws 63, 64 and loaded vertically downwardly with impermissibly high stress, a corresponding torque is exerted in the direction of arrow 77 onto the lever 74, but in particular onto the front lever component 74*a*. In order to avoid now an impermissible straining of the sewing good, this device initiates a specific torque when exceeding [this straining]. This is determined by a sensor which determines the bending angle between the two lever components 74*a*, 74*b*. This sensor 72 is provided as control element in the regulation of the lifting speed of the clamping device 62.

The extension of the two lever components 74*a*, 74*b* takes place spring-loaded through a compression spring 75 which is braced at an interval from the horizontal pivot axis 73 on the one lever component 74*a* as well as on the other lever component 74*b* and is adjustable by a pressure screw.

Thus if a predetermined torque, adjustable by the compression spring 75, in the direction of arrow 77 is exceeded, the front lever component 74*a* about its pivot axis 73 about the rear stationary lever component 74*b* downwardly in the direction of arrow 77 and hereby an impermissible tensile stress on the sewing good 4 is avoided.

Subsequently the motor is braked because the sensor 72 has detected this bending and a wait takes place until the sewing good has again built-up its original tensile stress such that under the effect of the compression spring 75 the two lever components 74*a*, 74*b* move again into their extended position and the lifting drive of the clamping device 72 is again accelerated.

The device is thus a torque trigger device, which avoids an impermissible tensile stress on the sewing good held in the clamping device 62 and which provides a corresponding mechanical triggers if the tensile stress is exceeded.

List of Reference Symbols

1 Sewing head
2 Sewing table
3 Frame (sewing machine)
4 Sewing good
5 Direction of arrow
6 Pressure foot
7 Clamping plate
8 Cylinder
9 Piston rod
10 Support
11 Guide part
12 Edge
13 Direction of arrow
14 Front edge (sewing edge)
15 Sewing good start 15'
16 Direction of arrow
17 Direction of arrow
19 Stacking device
20 Stacker flap
21 Axis
22 Sewing good stack
23 Lifting device
24 Belt device
25 Deflection wheel
26 Deflection wheel
27 Belt
28 Support surface
29 Needle
30 [sic]
31 Guide rod
32 Lifting cylinder
33 Metal deposition sheet
34 Pivot bearing
35 Cylinder (clamping device)
36 Cover (stacker 19)
37 Frame (stacker 19)
38 Guide rail (vertical clamping device)
39 Carriage
40 Cylinder

41 Proximity switch
42 Clamping clip
43 Bearing block
44 Pivot axis
45 Direction of arrow
46 Connection for air hose
47 Pivot bearing
48 Direction of arrow 48'
49 Housing
50 Switch
51 Creased fold (sewing good)
52 Vertical clamping device
53 Interspace
54 Direction of arrow 54'
55 Support plate
56 Transport gap
57 Vertical clamping device
58 Pattern [sic: stepping motor in specification]
59 Toothed belt
60 Deflection wheel
61 Carriage
62 Clamping device
63 Clamping jaw (upper)
64 Clamping jaw (lower)
65 Cylinder
66 Transport belt
67 Transfer slider
68 Cylinder
69 Piston rod
70 Lever
71 Driving motor for transport belt 66
72 Sensor
73 Pivot axis
74 Lever 74*a, b* lever components
75 Compression spring
76 Stop
77 Direction of arrow
78 Piston rod
79 Clamping cylinder
80 Carriage drive
81 Deflection roller
82 Guide rail
83 Direction of arrow
84 Direction of arrow

I claim:

1. Method for folding and stacking sewing goods wherein a stacking device disposed downstream of a sewing machine and separated from it by an interspace, and a transfer device bridging this interspace and succeeding transport device are available, through which the sewing good can be removed from the sewing machine and supplied to the stacking device, characterized in that a portion of the sewing good is introduced and clamped into a vertical clamping device (52, 57) disposed in the interspace, that the vertical clamping device (52, 57) carrying along the sewing good (4) is moved upward or downward by a defined distance, that the remaining portion of the sewing good (4) is taken hold of by the transfer device (10, 67) and, forming a creased fold (51), is supplied to a transport gap (56) defined by the transport device (24) and the stacking device (19), that the sewing good (4) with the creased fold ahead with the folding correct as to position is transported along the transport gap (56), wherein simultaneously the vertical clamping device (52, 57) with the clamped sewing good start (15) is moved upward or downward, that the vertical clamping device (52, 57) while opened releases the sewing good (4) and it is stacked disposed one on top of the other in the correct position by means of the stacking device (19).

2. Arrangement for folding and stacking sewing good, which is disposed downstream of a sewing machine and separated from it by an interspace, wherein a transfer device bridging this interspace and succeeding transport device are available, through which the sewing good is removed from the sewing machine and supplied to the stacking device, characterized in that in the interspace (53) a vertical clamping device (52, 57) is provided through which a portion of the sewing good (4) is taken hold of while being clamped and is transported by a defined distance in the vertical direction (48, 48'), wherein subsequently the remaining portion of the sewing good (4) is transported in a transport gap (56) formed through a support surface (28) of the stacking device (19) and a belt device (24) which with respect to it is raisable and lowerable.

3. Arrangement as claimed in claim 2, characterized in that the transport device (24) is implemented as a belt transport.

4. Arrangement as claimed in claim 3, characterized in that the transport device (24) comprises a frame on which are disposed partially driven deflection wheels (25, 26) over which runs a belt (27) and a lifting device (23) is provided for raising and lowering the transport device (24) with respect to the support surface (28) of the stacking device (19).

5. Arrangement as claimed in claim 3, characterized in that the transfer device comprises a support plate (55) on which a clamping plate (7) is disposed which is displaceable into the region of the interspace.

6. Arrangement as claimed in claim 3, characterized in that the vertical clamping device (52, 62) comprises a clamping clip (42) or clamping jaw (63, 64) actuatable by means of a cylinder (40, 79).

7. Arrangement as claimed in claim 3, characterized in that the vertical clamping device (52, 62) is disposed on a carriage (39, 61) movable vertically in a guide rail (38, 83).

8. Arrangement as claimed in claim 3, characterized in that the stacking device (19) comprises a stacker flap (20) disposed obliquely on a frame (37) and pivotable about a horizontal axis, wherein underneath the stacker flap (20) a metal deposition sheet (33) is disposed which is vertically height-adjustable.

9. Arrangement as claimed in claim 3, characterized in that in the region of the transfer device (7, 55) a blowing device is provided which supports the introduction of the sewing good (4) into the vertical clamping device (52).

10. Arrangement as claimed in claim 2, characterized in that the transport device (24) comprises a frame on which are disposed partially driven deflection wheels (25, 26) over which runs a belt (27) and a lifting device (23) is provided for raising and lowering the transport device (24) with respect to the support surface (28) of the stacking device (19).

11. Arrangement as claimed in claim 2, characterized in that the transfer device comprises a support plate (55) on which a clamping plate (7) is disposed which is displaceable into the region of the interspace.

12. Arrangement as claimed in claim 2, characterized in that the vertical clamping device (52, 62) comprises a clamping clip (42) or clamping jaw (63, 64) actuatable by means of a cylinder (40, 79).

13. Arrangement as claimed in claim 2, characterized in that the vertical clamping device (52, 62) is disposed on a carriage (39, 61) movable vertically in a guide rail (38, 83).

14. Arrangement as claimed in claim 2, characterized in that the stacking device (19) comprises a stacker flap (20) disposed obliquely on a frame (37) and pivotable about a horizontal axis, wherein underneath the stacker flap (20) a metal deposition sheet (33) is disposed which is vertically height-adjustable.

15. Arrangement as claimed in claim 2, characterized in that in the region of the transfer device (7, 55) a blowing device is provided which supports the introduction of the sewing good (4) into the vertical clamping device (52).

* * * * *